US005634949A

United States Patent [19]

Hohmann et al.

[11] Patent Number: 5,634,949

[45] Date of Patent: Jun. 3, 1997

[54] PREVENTION OF FABRIC HAND HARSHENING ON PRINTING OF DYEING CELLULOSIC TEXTILES

[75] Inventors: Kurt Hohmann, Neu-Isenburg; Peter Mischke, Bad Soden; Gerd Pelster, Kelkheim; Horst-Roland Mach, Glashütten, all of Germany

[73] Assignee: Hoechst AG, Frankfurt, Germany

[21] Appl. No.: 462,964

[22] Filed: Jun. 5, 1995

[30] Foreign Application Priority Data

Jun. 3, 1994 [DE] Germany ..... 44 19 533.8

[51] Int. Cl.[6] ..... D06P 3/66; D06P 1/38; C09B 67/24

[52] U.S. Cl. ..... 8/527; 8/543; 8/552; 8/557; 8/576; 8/581; 8/584; 8/609; 8/611; 8/613; 8/615; 8/918; 8/921; 8/912; 8/904; 8/907; 8/549

[58] Field of Search ..... 8/524–528, 543–9, 8/552, 563, 576, 584, 594, 597, 611, 615, 632, 918, 921, 912, 904, 907

[56] References Cited

U.S. PATENT DOCUMENTS

| | | | |
|---|---|---|---|
| 4,017,256 | 4/1977 | Kogel et al. | 8/907 X |
| 4,191,532 | 3/1980 | Gross et al. | 8/907 X |
| 4,198,204 | 4/1980 | von der Eltz et al. | 8/907 X |
| 4,849,770 | 7/1989 | Koike et al. | 346/1.1 |
| 5,356,441 | 10/1994 | Tokieda et al. | 8/543 |

OTHER PUBLICATIONS

CA 102:158100 abstract of JP 59119346 Jul. 10, 1984; Daicel Chemical Industries Inc.

*Primary Examiner*—Margaret Einsmann
*Attorney, Agent, or Firm*—Connolly & Hutz

[57] ABSTRACT

Cellulosic textiles are printed or dyed with multiple hook reactive dyes without fabric hand harshening on using a reactive dye preparation containing 0.5 to 10% by weight of a surfactant and 0 to 10% by weight of an antifoaming agent.

13 Claims, No Drawings

PREVENTION OF FABRIC HAND HARSHENING ON PRINTING OF DYEING CELLULOSIC TEXTILES

DESCRIPTION

The invention relates to the technical field of the preparations of water-soluble reactive dyes and their use for printing and dyeing cellulosic fiber materials.

Reactive dyes are industrially produced and used in large quantities, for example for preparing padding and dyeing liquors and for preparing print pastes with which textile materials are dyed and printed.

In addition to the various fastness properties required these days, another property which is important for the printed and dyed fiber material to be given a high rating is the fabric hand, since the consumer wants soft, flowing textile fabrics.

It has long been known that dyeing and especially printing may give rise to fabric hand harshening. The degree of the harshening depends on various factors. First, fabric hand harshening is product-specific and arises essentially in the case of regenerated cellulose, less so in the case of cotton. Furthermore, fabric hand harshening is observed in the case of double hook and multiple hook dyes. Precisely these dyes are becoming increasingly important, since their high degrees of fixation mean that less dye passes into the waste water and they therefore have ecologically favorable characteristics. Fabric hand harshening has hitherto been sought to be remedied by using, in particular in textile printing, monoreactive dyes while accepting a higher level of contamination of the waste waters.

Fabric hand harshening in textile printing is also dependent on the choice of thickener. For instance, high viscosity alginate thickeners show a distinct increase in harshening compared with medium and low viscosity alginate thickenings.

Similarly, carob bean flour ether and carboxymethylcellulose alone or mixed with alginate thickenings bring about a distinctly harsher fabric hand. Various synthetic thickeners likewise frequently lead to distinct fabric hand harshening.

Another important factor in the harshening of the textiles is the drying temperature. Temperatures above 130° C. dry (overdry) textile prints and, because of encrustation of the print film, this has an adverse effect on the fabric hand in the printed areas.

There has been no shortage of attempts to reduce fabric hand harshening by addition of auxiliaries to print pastes. An example of an auxiliary which has been proposed is urea, which, if used at above 120 to 200 g per kg of print paste, does bring about a marked improvement in fabric hand. However, disadvantages are the environmental problems, due to the high nitrogen levels in the waste waters, resulting from the high levels or urea used, and the application problems in the form of a resist effect on the reactive dyes due to ammonia formation and due to the formation of biuret at elevated temperatures (2-phase printing process/neutral print paste). Ammonia and biuret formation leads to a partial inactivation of the reactive groups and hence to a reduction in the yield of fixation (unlevel prints).

Similarly, the use of mineral oil-based printing oils which also contain emulsifiers does not have the ideally desired effect and constitutes a distinctly adverse impact on the environment.

It is therefore an object of the present invention to develop dye formulations whereby the otherwise customary disadvantageous fabric hand harshening on dyeing and especially on printing cellulosic textile materials, especially those composed of regenerated cellulose, can be safely avoided and a satisfactory soft hand results.

It has now been surprisingly found that prints and dyeings in the presence of the below-described auxiliaries lead especially on regenerated cellulose to a soft hand which barely differs, if at all, from that of the unprinted material.

The invention accordingly provides a method for preventing fabric hand harshening on printing or dyeing cellulosic textile materials, which comprises performing the printing or dyeing of the textile material with a dye preparation which consists essentially of one or more reactive dyes having at least two reactive groups, 0.5 to 10% by weight, preferably 1 to 7% by weight, of a surfactant, preferably a nonionic surfactant, and 0 to 10% by weight, preferably 0.05 to 10% by weight, particularly preferably 0.1 to 6% by weight, of an antifoaming agent of antifoaming agent mixture, in each case based on the weight of the dye preparation.

In the case of minimal foam formation, the antifoam can be dispensed with.

The present invention further provides a dye preparation consisting essentially of one or more reactive dyes having at least two reactive groups, 0.5 to 36.6% by weight, preferably 1 to 29.8% by weight, of a surfactant, preferably a nonionic surfactant, and 0.05 to 10% by weight, preferably 0.1 to 6% by weight, of an antifoaming agent or of an antifoaming agent mixture.

Surfactants which produce a soft fabric hand are for example: fatty alcohols having 8 to 22 carbon atoms, for example cetyl alcohol, addition products of preferably 2 to 40 alkylene oxide units, especially ethylene oxide and/or propylene oxide, with saturated or unsaturated $C_8$–$C_{22}$ monoalcohols, for example coco fat alcohols, stearyl alcohols or oleyl alcohols, with fatty acids, with fatty amides or with fatty amines each having 8 to 22 carbon atoms or with phenylphenol or with $C_4$–$C_{12}$-alkylphenols, for example nonylphenol or tributylphenol; block polymers of 10 to 50% by weight of ethylene oxide units and 90 to 50% by weight of propylene oxide units having a molecular weight of 250 to 5000; $C_{12}$–$C_{18}$-alkyl-N-methylgluconamides; sulfosuccinic acid derivatives of ethoxylated nonylphenol-formaldehyde condensation products and the sulfosuccinic monoesters described in DE-A-2 132 403 which corresponds to U.S. Pat. No. 3,775,056, polyglycols having a molecular weight of 200 to 2000, in particular 800 to 1200, and polyglycol ethers having a molecular weight of 200 to 1000, in particular polyethylene glycol dimethyl ethers or diethyl ethers having a molecular weight of 200 to 1000.

Preferred surfactants are for example (EO is ethylene oxide): coco fat alcohol polyglycol ether having 5 to 20 EO units, stearyl alcohol polyglycol ether having 5 to 50 EO units, oleyl alcohol polyglycol ether having 2 to 23 EO units, isotridecyl alcohol polyglycol ether having 3 to 15 EO units, coco fatty acid polyglycol ester having 5 to 20 EO units, stearic acid polyglycol ester having 5 to 20 EO units, oleic acid polyglycol ester having 5 to 20 EO units, lauryl alcohol polyglycol phosphate, castor oil polyglycol ester having 10 to 40 EO units, nonylphenol polyglycol ether having 5 to 25 EO units, block polymers composed of 10 to 50% by weight of ethylene oxide units and 50 to 90% by weight of propylene oxide units and having a molecular weight of 250 to 5000, preferably 350 to 2500, and $C_{12}$–$C_{16}$-alkyl-N-methylgluconamide.

The surfactants used according to the invention can be used individually or advantageously in mixtures of two or more.

Since most of the surfactants used according to the invention tend to foam, it is usually necessary to add antifoams, for example those based on acetylenediol, for example 2,4,7,9-tetramethyl-5-decyne-4,7-diol without a solvent or as solution in ethylene glycol, ethylhexanol, butoxyethanol, propylene glycol, isopropanol or dipropylene glycol; or also ethylhexanol, octanol, $C_1$–$C_4$-alkyl phosphates, for example tri-n-butyl phosphate or triisobutyl phosphate; perfluorinated $C_6$–$C_{10}$-alkylphosphinic acids and perfluorinated $C_6$–$C_{10}$-alkylphosphonic acids and also mixtures of the compounds mentioned and also antifoams based on silicone which are used in particular in mixture with emulsifiers.

The dyes used according to the invention are reactive dyes which are customarily used for printing and dyeing cellulosic textile materials but which, for the aforementioned reasons, contain two or more reactive groups and form a chemical bond with the cellulose via their reactive groups.

Fiber-reactive groups are for example those of the vinylsulfonyl and vinylsulfonamide series, of the halogen-substituted s-triazinylamino and of the halogen-substituted pyrimidylamino series and of the series of the optionally halogen-substituted aliphatic carboxamides, such as the chloracetamide, the acryloylamide, the β-bromopropionylamide and the α,β-dibromopropionylamide radical. As well as via an amino grouping, these fiber-reactive groups can also be bonded to the actual dye radical via an aliphatic, aromatic or araliphatic bridge member or via a bridge member comprising an alkylene radical bonded to a carboxamide or sulfonamide radical. Such fiber-reactive groupings are well known in the literature, for example from DE-A-2 201 280, DE-A-2 927 102, DE-A-1 265 698, DE-A-2 614 550, EP-A-0 040 806, EP-A-0 040 790, EP-A-070 807, EP-A-0 141 367, EP-A-0 144 766, EP-A-0 361 440, EP-A-0 374 758 and EP-A-0 377 166 and also the references mentioned in these documents.

The reactive dyes used in the process of the invention can belong to a wide variety of chemical classes, such as the monoazo, disazo or triazo dyes which, after their synthesis, can also be converted into metal complex derivatives, as into their 1:1 copper, 1:2 chromium and 1:2 cobalt complex azo dyes, the anthraquinone dyes, the copper formazan dyes, the phthalocyanine dyes, for example the copper and nickel phthalocyanine dyes, the dioxazine, the stilbene, coumarin and triphenylmethane dyes.

The dye preparations of the invention can include the double hook or multiple hook reactive dyes individually or mixed with one another or in mixture with monoreactive dyes. The dye preparations include the reactive dye(s) in customary concentrations, preferably 5 to 40% strength by weight solutions.

The present invention also relates to a process for preparing the reactive dye preparation of the invention by homogeneously mixing the individual above-described components together and optionally subjecting the resulting mixture to a spray drying or spray granulation. This gives liquid or solid pulverulent or granular reactive dye preparations.

The dyeing of cellulosic textiles with a reactive dye preparation of the invention is carried out by customary methods, for example by pad-dye methods.

The cellulosic textiles are for example those composed of regenerated cellulose or native cellulose fibers and their blends with synthetic fibers.

The present invention also provides a print paste consisting essentially of the reactive dye preparation of the present invention and a customary alginate thickening, for example sodium alginate.

The print paste can be prepared by first adding the surfactants and antifoaming agents to an alginate stock thickening and then mixing with the reactive dye(s) or mixing the reactive dye preparation with an alginate thickening.

The printing of cellulosic textiles with a print paste of the invention is carried out by the method of single-phase printing or of two-phase printing. The single-phase printing of cellulosic textile materials in direct printing with reactive dyes has been known for a long time. In contradistinction to two-phase printing processes, where the print color is added without the alkaline fixing aid and the latter is only applied to the printed and dried material in a separate operation, i.e. in a second phase, the print pastes for single-phase application directly contain the alkali necessary for fixing the reactive dyes on the printed cellulose fibers, traditionally in the form of sodium bicarbonate or sodium carbonate. After printing and drying, such single-phase prints are fixed by treatment with saturated steam at 100° to 106° C.

In the examples which follow, parts are by weight unless otherwise stated. Parts by weight bear the same relation to parts by volume as the kilogram to the liter. EO is ethylene oxide.

EXAMPLE 1 a) 948 parts of a dye solution which contains 27% of the dye C. I. Reactive Black 5:

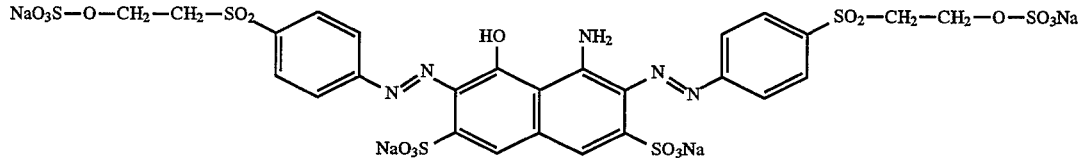

are successively admixed at about 50° C. with 44.5 parts of an ethylene oxide-propylene oxide polymerization product which contains 60% of polypropylene oxide (molecular weight 1750) and 40% of EO in the molecule and 7.5 parts of 2,4,7,9-tetramethyl-5-decyne-4,7-diol by stirring. Stirring is subsequently continued for 2 to 3 hours until the mixture is cooled down to room temperature and has been turned to a homogeneous solution.

b) To 140 to 180 g of the above-prepared reactive black dye preparation are added under high-speed stirring:

| | |
|---|---|
| 100 g | of urea |
| 200 g | of demineralized water (40° C.) |
| 420 g | of low-viscosity alginate thickening (8.5%) |
| 50 g | of sodium m-nitrobenzenesulfonate (as aqueous solution 1:4) |

-continued

| | |
|---|---|
| 25 g | of $NaHCO_3$ |
| 65–25 g | of water or thickening |
| 1000 g | of print paste. |

Single-phase reactive printing on regenerated cellulose gives navy to black prints without fabric hand harshening.

c) A cellulose textile is printed with a print paste homogenized by intensive stirring of the below-indicated constituents.

To 140 to 180 g of the reactive black dye preparation prepared in a) are added under high-speed stirring:

| | |
|---|---|
| 300 g | of water, 40° C. |
| 420 g | of low-viscosity alginate thickening (8.5%) |
| 50 g | of sodium m-nitrobenzenesulfonate (as aqueous solution 1:4) |
| 2 g | of monosodium phosphate |
| 88–48 g | of water or thickening |
| 1000 g | of print paste. |

Two-phase reactive printing produces navy to black textile prints without fabric hand harshening.

d) A cellulose textile is printed with a print paste homogenized by intensive stirring of the below-indicated constituents.

To 140 to 180 g of a solution which contains 27% of the dye C. I. Reactive Black 5 are added under high-speed stirring:

| | |
|---|---|
| 100 g | of urea |
| 200 g | of water, 40° C. |
| 420 g | of stock thickening |
| 50 g | of sodium m-nitrobenzenesulfonate (as aqueous solution 1:4) |
| 25 g | of sodium bicarbonate |
| 65–25 g | of water or thickening |
| 1000 g | of print paste. |

Stock thickening for single- and two-phase printing processes

| | |
|---|---|
| 848.88 g | of cold water |
| 5.00 g | of condensed phosphates, for example ® Calgon |
| 0.12 g | of preservative based on dithiocarbamates and benzimidazole derivatives |
| 100.00 g | of low-viscosity alginate thickening |
| 30.00 g | of ® Printol S |
| 7.00 g | of fatty alcohol with 40 EO units |
| 7.00 g | of ethylene oxide-propylene oxide polymer (40% of EO) |
| 2.00 g | of perfluorinated alkylphosphinic acids/ alkylphosphonic acids |
| 1000 g | |

Single- and two-phase printing produces navy to black prints having a soft hand.

Comparative prints with the same dye solution but no surfactant have distinctly poorer hand characteristics.

EXAMPLES 2 TO 7

Example 1a is repeated to prepare a reactive black dye preparation by replacing the surfactant used there with each of the following surfactants in turn:

| Example | Parts | Surfactant | Number of EO units |
|---|---|---|---|
| 2 | 44.5 | Ethoxylated vegetable oil | 40 EO |
| 3 | 44.5 | Nonylphenol polyglycol ether | 10 EO |
| 4 | 44.5 | Stearyl alcohol polyglycol ether | 18 EO |
| 5 | 44.5 | Coco fatty acid polyglycol ester | 8 EO |
| 6 | 44.5 | Coco fatty acid polyglycol ether | 6–8 EO |
| 7 | 22.5 | Tributylphenol polyglycol ether | 8 EO |
| | 22.5 | Isotridecyl alcohol polyglycol ether | 5 EO |

A print paste prepared similar to Example 1b and applied to regenerated cellulose produces navy to black prints having a similar fabric hand.

EXAMPLE 8

472 parts of a dye solution containing 27% of the dye C. I. Reactive Black 5 are successively admixed at about 50° C. with 12 parts of an ethylene oxide-propylene oxide polymerization product which contains 60% of polypropylene oxide (molecular weight 1750) and 40% of EO in the molecule, 12 parts of ethoxylated vegetable oil+40 EO, and 4 parts of triisobutyl phosphate by stirring. Stirring is subsequently continued for 2 to 3 hours until the mixture is cooled down to room temperature and has been turned to a homogeneous solution.

A print paste prepared similarly to Example 1b and applied to regenerated cellulose gives navy to black prints without fabric hand harshening.

Comparative prints with the same dye solution but no surfactant have distinctly worse (harsher) hand characteristics.

EXAMPLES 9 TO 13

Example 8 is repeated to prepare a reactive black dye preparation by replacing the surfactant used there by each of the following surfactants in turn:

| Example | Parts | Surfactant | Number of EO units |
|---|---|---|---|
| 9 | 12 | Ethoxylated vegetable oil | 40 EO |
| 10 | 12 | Oleyl alcohol polyglycol ether | 20 Eo |
| 11 | 12 | Nonylphenol polyglycol ether | 9% EO |
| 12 | 12 | Isotridecyl alcohol polyglycol ether | 15 EO |
| 13 | 6 | Stearic acid polyglycol ester | 8 EO |
| | 6 | Coco fatty acid polyglycol ester | 10 EO |

A print paste prepared similarly to Example 1b and applied to regenerated cellulose gives navy to black prints having a similar hand.

EXAMPLE 14

190 parts of a dye solution which contains 13.4% of the dye C. I. Reactive Black 5 and about 6.1% of the dye C. I. Reactive Orange 72:

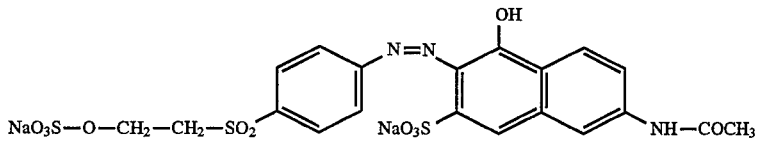

are successively admixed at about 25° C. with 5 parts of an ethylene oxide-propylene oxide polymerization product which contains 60% of polypropylene oxide (molecular weight 1750) and 40% of EO in the molecule, 3 parts of ethoxylated vegetable oil+40 EO and 2 parts of a solution of a water-miscible antifoam based on perfluorinated alkylphosphinic/-phosphonic acids by stirring. Stirring is subsequently continued for 2 to 3 hours until a homogeneous solution has formed.

A print paste prepared similarly to Example 1b and applied to regenerated cellulose produces navy to black prints without fabric hand harshening.

Comparative prints with the same dye solution but without surfactant have distinctly worse hand characteristics.

EXAMPLES 15 TO 18

Example 14 is repeated to prepare a reactive dye preparation by replacing the surfactant used there with each of the following surfactants in turn:

| Example | Parts | Surfactant | Number of EO units |
|---|---|---|---|
| 15 | 5 | Ethoxylated vegetable oil | 30 EO |
| 16 | 5 | Nonylphenol polyglycol ether | 11 EO |
| 17 | 5 | Stearyl alcohol polyglycol ether | 20 EO |
| 18 | 5 | Oleic acid polyglycol ester | 6 EO |

A print paste prepared similar to Example 1b and applied to regenerated cellulose produces navy to black prints having a similar fabric hand.

EXAMPLE 19

190 parts of a dye solution which contains 13.4% of the dye C. I. Reactive Black 5:

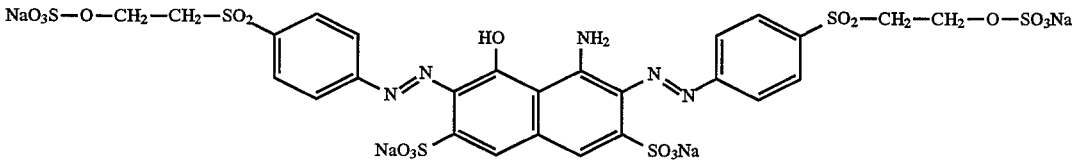

and about 6.1% of the dye C. I. Reactive Orange 72:

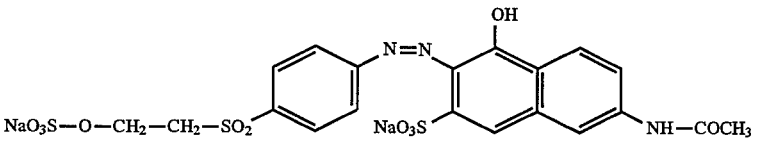

are successively admixed at about 25° C. with 2 parts of an ethylene oxide-propylene oxide polymerization product which contains 60% of polypropylene oxide (molecular weight 1750) and 40% of EO in the molecule, 2 parts of ethoxylated vegetable oil+40 EO, 1 part of coco fatty acid polyglycol ester+8 EO, 1 part of coco fatty alcohol polyglycol ether+8 EO, 1 part of stearic acid polyglycol ester+10 EO, 1 part of lauryl alcohol polyglycol phosphate, and 2 parts of antifoam consisting of a solution of a water-miscible silicone-free antifoam based on a fluorine-containing surfactant. Stirring is subsequently continued for 2 to 3 hours until a homogeneous solution has formed.

A print paste prepared similarly to Example 1b, 1c and 1d and applied to regenerated cellulose produces navy to black prints without fabric hand harshening.

Comparative prints with the same dye solution but without surfactant have distinctly worse hand characteristics.

Instead of the antifoam used it is also possible to use ethylhexanol, octanol, triisobutyl phosphate, tributyl phosphate, 2,4,7,9-tetramethyl-5-decyne-4,7-diol without a solvent or as a solution in glycol, ethylhexanol, butoxyethanol, propylene glycol, isopropanol or dipropylene glycol or else mixtures thereof.

EXAMPLE 20

189 parts of a dye solution which contains 13.4% of the dye C. I. Reactive Black 5 and about 6.1% of the dye C. I. Reactive Orange 72 are successively admixed at about 25° C. with 2 parts of an ethylene oxide-propylene oxide polymerization product which contains 60% of polypropylene oxide (molecular weight 1750) and 40% of EO in the molecule, 5 parts of ethoxylated vegetable oil+40 EO, 1 part of condensation product of naphthalenesulfonic acid with formaldehyde, and 2 parts of a solution of water-miscible antifoam based on perfluorinated alkylphosphinic acids and alkylphosphonic acids by stirring. Stirring is subsequently continued for 2 to 3 hours until a homogeneous solution has formed.

A print paste prepared similarly to Example 1b and 1c and applied to regenerated cellulose produces navy to black prints without fabric hand harshening.

Comparative prints with the same dye solution but without surfactant have distinctly worse hand characteristics.

EXAMPLES 21 TO 24

Example 20 is repeated to prepare a reactive black dye preparation by replacing the surfactant used there with each of the following surfactants in turn:

| Example | Parts | Surfactant | Number of EO units |
|---|---|---|---|
| 21 | 2 | Ethoxylated vegetable oil | 30 EO |
| 22 | 2 | Nonylphenol polyglycol ether | 11 EO |
| 23 | 2 | Stearyl alcohol polyglycol ether | 20 EO |
| 24 | 2 | Oleic acid polyglycol ester | 6 EO |

A print paste prepared similarly to Examples 1*b* and 1*c* and applied to regenerated cellulose produces navy to black prints having a similar fabric hand.

EXAMPLE 25

189 parts of a dye solution which contains about 13% of the dye C. I. Reactive Blue 203:

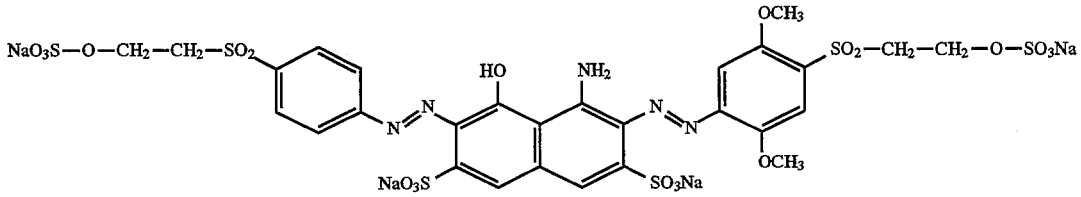

are successively admixed at about 25° C. with 2 parts of an ethylene oxide-propylene oxide polymerization product which contains 60% of polypropylene oxide (molecular weight 1750) and 40% of EO in the molecule, 6 parts of ethoxylated vegetable oil+40 EO, I part of a condensation product of naphthalenesulfonic acid with formaldehyde and 2 parts of a solution of a water-miscible silicone-free antifoam based on perfluorinated alkylphosphinic acids and alkylphosphonic acids by stirring. Stirring is subsequently continued for 2 to 3 hours until a homogeneous solution has formed.

A print paste prepared similarly to Examples 1*b* and 1*c* and applied to regenerated cellulose produces navy prints without fabric hand harshening.

Comparative prints with the same dye solution but without surfactant have distinctly worse hand characteristics.

EXAMPLES 26 TO 29

Example 25 is repeated to prepare a reactive black dye preparation by replacing the nonionic surfactant used there by each of the following surfactants in turn:

| Example | Parts | Surfactant | Number of EO units |
|---|---|---|---|
| 26 | 2 | Ethoxylated vegetable oil | 20 EO |
| 27 | 2 | Nonylphenol polyglycol ether | 11 EO |
| 28 | 2 | Stearyl alcohol polyglycol ether | 18 EO |
| 29 | 2 | Oleic acid polyglycol ester | 6 EO |

A print paste prepared similarly to Examples 1*b* and 1*c* and applied to regenerated cellulose produces navy to black prints having a similar fabric hand.

EXAMPLE 30

200 parts of a dye solution which contains 26% of the dye C. I. Reactive Black 5 and 23 parts of sodium chloride are successively admixed at about 50° C. with 4 parts of an ethylene oxide-propylene oxide polymerization product which contains 60% of polypropylene oxide (molecular weight 1750) and 40% of EO in the molecule, 3 parts of ethoxylated vegetable oil+40 EO, 4 parts of condensation product of naphthalenesulfonic acid and formaldehyde, and 0.5 part of a self-emulsifiable vegetable oil by stirring. Following the addition of 15 parts of sodium sulfate, anhydrous, stirring is subsequently continued for 2 to 3 hours with cooling down to about 30° C. until a homogeneous solution has formed. The solution is then spray-dried to about 100 g of a dye preparation which on use of the commercially available stock thickenings based on alginate produces in single-phase reactive printing on cellulose navy to black prints without fabric hand harshening.

Comparative prints with the same dye preparation but without surfactants have distinctly worse hand characteristics.

Replacing the 3 parts of the ethoxylated vegetable oil+40 EO by 3 parts of ethoxylated oleyl alcohol+23 EO or 3 parts of a nonylphenol polyglycol ether+23 EO or 3 parts of an isotridecyl alcohol polyglycol ether+15 EO or 3 parts of coco fatty acid polyglycol ester+10 EO or 3 parts of stearyl polyglycol ether+25 EO or 3 parts of stearyl polyglycol ether+50 EO likewise results in textile prints having very good fabric hand characteristics.

EXAMPLE 31

200 parts of a dye solution which contains 26% of the dye C. I. Reactive Black 5 and 23 parts of sodium chloride are successively admixed at about 50° C. with 4 parts of an ethylene oxide-propylene oxide polymerization product which contains 60% of polypropylene oxide (molecular weight 1750) and 40% of EO in the molecule, 3 parts of ethoxylated vegetable oil+40 EO, 2 parts of polyacrylate with an average molecular weight of 70 000, 6 parts of condensation product of naphthalenesulfonic acid and formaldehyde, 0.5 part of 2,4,7,9-tetramethyl-5-decyne-4,7-diol and 0.5 part of a self-emulsifiable vegetable oil by stirring. Following the addition of 11 parts of sodium sulfate, anhydrous, stirring is subsequently continued for 2 to 3 hours with cooling down to about 30° C. until a homogeneous solution has formed. The solution is then spray-dried to about 100 g of a dye preparation which on use of the commercially available stock thickenings based on alginate produces in single- and two-phase reactive printing on cellulose navy to black prints without fabric hand harshening. Comparative prints with the same dye preparation but without surfactants have distinctly worse hand characteristics.

Replacing the 3 parts of the ethoxylated vegetable oil+40 EO by 3 parts of ethoxylated oleyl alcohol+23 EO or 3 parts of a nonylphenol polyglycol ether+23 EO or 3 parts of an isotridecyl alcohol polyglycol ether+20 EO or 3 parts of coco fatty acid polyglycol ester+20 EO or 3 parts of stearyl polyglycol ether+25 EO or 3 parts of stearyl polyglycol ether+50 EO likewise results in textile prints having very good fabric hand characteristics.

EXAMPLE 32

190 parts of a dye solution which contains 13.4% of the dye C. I. Reactive Black 5 and about 6.1% of the dye C. I. Reactive Orange 72 are successively admixed at about 25° C. with 2 parts of an ethylene oxide-propylene oxide polymerization product which contains 60% of polypropylene oxide (molecular weight 1750) and 40% of EO in the molecule, 2 parts of ethoxylated vegetable oil+40 EO, 1 part of coco fatty acid polyglycol ester+8 EO, 1 part of coco fatty alcohol polyglycol ether+8 EO, 1 part of stearic acid polyglycol ester+10 EO, 1 part of lauryl alcohol polyglycol phosphate, and 2 parts of antifoam consisting of a solution of a water-miscible antifoam based on perfluorinated alkylphosphonic/-phosphonic acids by stirring. Stirring is subsequently continued for 2 to 3 hours until a homogeneous solution has formed. The dye preparation thus prepared, applied to cellulose by single- and two-phase reactive printing using commercially available alginate-based stock thickenings, produces deep black textile prints without fabric hand harshening. Comparative prints with the same dye solution but without surfactants have distinctly worse hand characteristics.

Instead of the antifoam used in the example it is also possible to use ethylhexanol, octanol, triisobutyl phosphate, tributyl phosphate, 2,4,7,9-tetramethyl-5-decyne-4,7-diol without a solvent or as solution in glycol, ethylhexanol, butoxyethanol, propylene glycol, isopropanol or dipropylene glycol or else mixtures thereof.

EXAMPLE 33

The cellulose textile is printed with a print paste prepared by intensive stirring together of the below-indicated constituents at room temperature:

| | |
|---|---|
| 140–180 g | of dye preparation according to Example 1 |
| 120 g | of urea |
| 150 g | of demineralized water, 40° C. |
| 450 g | of stock thickening |
| 50 g | of sodium nitrobenzenesulfonate |
| 25 g | of sodium bicarbonate |
| 65–25 g | of balance (water or stock thickening) |
| 1000 g | |

Stock thickening:

| | |
|---|---|
| 909.88 g | of cold demineralized water |
| 5.00 g | of condensed phosphates, for example ® Calgon |
| 0.12 g | of preservative based on dithiocarbamates + benzimidazole derivatives |
| 15.00 g | of sodium alginate, high viscosity |
| 70.00 g | of sodium alginate, low viscosity |
| 1000 g | |

The printed material is dried at 120° C. for 2 to 5 min. To fix the printed dye, the treated material is steamed at 102° C. for 8 min, then rinsed with water, soaped under neutral conditions and finally finished. The above print recipe produces on textile materials made of viscose a soft fabric hand.

What is claimed is:

1. A method for preventing fabric hand harshening on printing or pad dyeing cellulosic textile materials, by performing the printing or dyeing of the textile material with a dye preparation which consists essentially of 5 to 40 % by weight of one or more reactive dyes having at least two reactive groups, 0.5 to 10% by weight of a surfactant which is a $C_8$–$C_{22}$ fatty alcohol, a saturated or unsaturated $C_8$–$C_{22}$ monoalcohol polyglycol ether having a total 2 to 50ethylene oxide units, a lauryl alcohol polyglycol phosphate, castor oil polyglycol ester having 10 to 40 ethylene units, propylene oxide units or a combination thereof, a condensation product of a saturated or unsaturated $C_8$–$C_{22}$-fatty acid having 2 to 40 ethylene oxide units, propylene oxide units or a combination thereof, a condensation product of a $C_8$–$C_{22}$ fatty amine or $C_8$–$C_{22}$ fatty acid amide having in each case 2 to 40 ethylene oxide units, propylene oxide units or a combination thereof, a condensation product of naphthalenesulphonic acid with formaldehyde, polyglycols having a molecular weight of 200 to 2,000, polyglycol ethers having a molecular weight of from 200 to 1,000, a mixture of polyglycols having a molecular weight of 200 to 2,000 and polyglycol ethers having a molecular weight of from 200 to 1,000, a condensation product of a $C_4$–$C_{12}$-alkyl-phenol or of phenylphenol having in each case 2 to 40 ethylene oxide units, propylene oxide units or a combination thereof, a block polymer of 10 to 50% by weight of ethylene oxide units and 90 to 50% by weight of propylene oxide units having a molecular weight of 250 to 5,000, a $C_{12}$–$C_{18}$-alkyl-N-methylgluconamide or a mixture of the compounds mentioned, and 0.1% to 10% by weight of an antifoaming agent or antifoaming agent mixture which is an acetylenediol, a $C_1$–$C_4$-alkyl phosphate, a perfluorinated $C_6$–$C_{10}$-alkylphosphinic acid, a perfluorinated $C_6$–$C_{10}$-alkylphosphonic acid, a silicone or a mixture of the antifoaming agents mentioned.

2. The method of claim 1, wherein the dye preparation used consists essentially of one or more reactive dyes having at least two reactive groups, 1 to 7% by weight of a $C_8$–$C_{22}$ fatty alcohol, a saturated or unsaturated $C_8$–$C_{22}$ monoalcohol polyglycol ether having in total 2 to 40 ethylene oxide units, propylene oxide units or a combination thereof, a condensation product of a saturated or unsaturated $C_8$-$C_{22}$-fatty acid having 2 to 40 ethylene oxide units, propylene oxide units or a combination thereof, a condensation product of a saturated or unsaturated $C_8$–$C_{22}$ fatty amine or $C_8$–$C_{22}$ fatty acid amide having in each case 2 to 40 ethylene oxide units, propylene oxide units or a combination thereof, a condensation product of a $C_4$–$C_{12}$-alkyl-phenol or of phenylphenol having in each case 2 to 40 ethylene oxide units, propylene oxide units or a combination thereof, a block polymer of 10 to 50% by weight of ethylene oxide units and 90 to 50% by weight of propylene oxide units having a molecular weight of 250 to 5000, a $C_{12}$–$C_{18}$-alkyl-N-methylgluconamide or a mixture of the compounds mentioned, and 0.1 to 6% by weight of an acetylenediol, of a $C_1$–$C_4$-alkyl phosphate, of a perfluorinated $C_6$–$C_{10}$-alkylphosphinic acid, a perfluorinated $C_6$–$C_{10}$-alkylphosphonic acid, a silicone or a mixture of the antifoaming agents mentioned.

3. The method of claim 2, wherein the dye preparation used consists essentially of a monoazo, disazo or trisazo dye or a metal complex of the azo dyes mentioned, an anthraquinone, copper formazan, phthalocyanine, stilbene, coumarin or triphenylmethane dye, 1 to 7% by weight of a coco fat alcohol polyglycol ether having 5 to 20 ethylene oxide units, stearyl alcohol polyglycol ether-having 5 to 50 ethylene oxide units, oleyl alcohol polyglycol ether having 2 to 23 ethylene oxide units, isotridecyl alcohol polyglycol ether having 3 to 15 ethylene oxide units, coco fatty acid polyglycol ester having 5 to 20 ethylene oxide units, stearic acid polyglycol ester having 5 to 20 ethylene oxide units, oleic acid polyglycol ester having 5 to 20 ethylene oxide units, lauryl alcohol polyglycol phosphate, castor oil polyglycol ester having 10 to 40 ethylene oxide units, nonylphenol polyglycol ether having 5 to 25 ethylene oxide units, a block polymer composed of 10 to 50% by weight of ethylene oxide units and 50 to 90% by weight of propylene oxide units and having a molecular weight of 250 to 5000, or a $C_{12}$–$C_{16}$-alkyl-N-methylgluconamide, and 0.1 to 6% by weight of 2,4,7,9-tetramethyl-5-decyne-4,7-diol, tri-n-butyl phosphate, triisobutyl phosphate.

4. A reactive dye preparation consisting essentially of 5 to 40% by weight of one or more reactive dyes having at least two reactive groups, 0.5 to 10% by weight of a surfactant which is a $C_8$–$C_{22}$ fatty alcohol, a saturated or unsaturated $C_8$–$C_{22}$ monoalcohol polyglycol ether having in total 2 to 50 ethylene oxide units, a lauryl alcohol polyglycol phosphate, castor oil polyglycol ester having 10 to 40 ethylene units, propylene oxide units or a combination thereof, a condensation product of a saturated or unsaturated $C_8$–$C_{22}$-fatty acid having 2 to 40 ethylene oxide units, propylene oxide units or a combination thereof, a condensation product of a $C_8$–$C_{22}$ fatty amine or $C_8$–$C_{22}$ fatty acid amide having in each case 2 to 40 ethylene oxide units, propylene oxide units or a combination thereof, a condensation product of naphthalenesulphonic acid with formaldehyde, polyglycols having a molecular weight of 200 to 2,000, polyglycol ethers having a molecular weight of from 200 to 1,000, a mixture of polyglycols having a molecular weight of 200 to 2,000 and polyglycol ethers having a molecular weight of from 200 to 1,000, a condensation product of a $C_4$–$C_{12}$-alkylphenol or of phenylphenol having in each case 2 to 40 ethylene oxide units, propylene oxide units or a combination thereof, a block polymer of 10 to 50% by weight of ethylene oxide units and 90 to 50% by weight of propylene oxide units having a molecular weight of 250 to 5,000, a $C_{12}$–$C_{18}$-alkyl-N-methylgluconamide or a mixture of the compounds mentioned, and 0.05 to 10% by weight of an antifoaming agent which is 2,4,7,9-tetramethyl-5-decyne-4,7-diol,tri-n-butyl-phosphate, triisobutyl phosphate, ethylhexanol or octanol or a mixture thereof.

5. The reactive dye preparation of claim 4, wherein the surfactant is a $C_8$–$C_{22}$ fatty alcohol, a saturated or unsaturated $C_8$-$C_{22}$ monoalcohol polyglycol ether having in total 2 to 40 ethylene oxide units, propylene oxide units or a combination thereof, a condensation product of a saturated or unsaturated $C_8$–$C_{22}$ fatty acid having 2 to 40 ethylene oxide units, propylene oxide units or a combination thereof, a condensation product of a saturated or unsaturated $C_8$–$C_{22}$ fatty amine or $C_8$–$C_{22}$ fatty acid amide having in total 2 to 40 ethylene oxide units, propylene oxide units or a combination thereof, a condensation product of a $C_4$–$C_{12}$-alkylphenol or of phenylphenol having in total 2 to 40 ethylene oxide units, propylene oxide units or a combination thereof, a block polymer of 10 to 50% by weight of ethylene oxide units and 90 to 50% by weight of propylene oxide units having a molecular weight of 250 to 5000, a $C_{12}$–$C_{18}$-alkyl-N-methylgluconamide, polyglycols having a molecular weight of 200 to 2000, and polyglycol ethers having a molecular weight of from 200 to 1000, or a mixture thereof.

6. The reactive dye preparation of claim 4, wherein the surfactant is a coco fat alcohol polyglycol ether having 5 to 20 ethylene oxide units, stearyl alcohol polyglycol ether having 5 to 50 ethylene oxide units, oleyl alcohol polyglycol ether having 2 to 23 ethylene oxide units, isotridecyl alcohol polyglycol ether having 3 to 15 ethylene oxide units, coco fatty acid polyglycol ester having 5 to 20 ethylene oxide units, stearic acid polyglycol ester having 5 to 20 ethylene oxide units, oleic acid polyglycol ester having 5 to 20 ethylene oxide units, lauryl alcohol polyglycol phosphate, castor oil polyglycol ester having 10 to 40 ethylene oxide units, nonylphenol polyglycol ether having 5 to 25 ethylene oxide units, a block polymer composed of 10 to 50% by weight of ethylene oxide units and 50 to 90% by weight of propylene oxide units and having a molecular weight of 250 to 5000, or a $C_{12}$–$C_{16}$-alkyl-N-methylgluconamide.

7. The reactive dye preparation of claim 4, wherein the reactive dye or dyes is or are a monoazo, disazo or trisazo dye or a metal complex of the azo dyes mentioned, anthraquinone, copper formazan, phthalocyanine, stilbene, coumarin or triphenylmethane dye.

8. The method of pad dyeing cellulosic textile materials comprising the step of applying a reactive dye preparation as claimed in claim 4 onto said textile material.

9. A printing paste consisting essentially of a reactive dye preparation as claimed in claim 4 and an alginate thickening.

10. The method of printing cellulosic textile materials comprising the step of applying a printing paste as claimed in claim 9 onto said textile material.

11. The process as claimed in claim 1, wherein the reactive dyes are selected from the group consisting of C. I. Reactive Black 5, C. I. Reactive Blue 203 and a mixture of C. I. Reactive Black 5 with C. I. Reactive Orange 72.

12. The reactive dye preparation as claimed in claim 7, wherein the reactive dyes are selected from the group consisting of C. I. Reactive Black 5, C. I. Reactive Blue 203 and a mixture of C. I. Reactive Black 5 with C. I. Reactive Orange 72.

13. The printing paste as claimed in claim 9, wherein the reactive dyes are, selected from the group consisting of C. I. Reactive Black 5, C. I. Reactive Blue 203 and a mixture of C. I. Reactive Black 5 with C. I. Reactive Orange 72.

* * * * *